US005979441A

United States Patent [19]

Hsieh

[11] Patent Number: 5,979,441

[45] Date of Patent: Nov. 9, 1999

[54] STRUCTURE OF DRAINING MECHANISM FOR SOFT NOSE PROTRUSION TYPE DIVING MASK

[76] Inventor: Hsing-Chi Hsieh, No. 51, Wan An Street, Taipei, Taiwan

[21] Appl. No.: 09/104,057

[22] Filed: Jun. 24, 1998

[51] Int. Cl.[6] ..... B63C 11/02

[52] U.S. Cl. ..... 128/201.28; 128/200.29; 128/201.27

[58] Field of Search ..... 128/201.27, 201.28, 128/200.29, 201.24, 205.25, 206.24, 207.12, 201.11, 201.18

[56] References Cited

U.S. PATENT DOCUMENTS 5,329,643 7/1994 Sato ..... 2/428
5,608,920 3/1997 Oliver et al. ..... 2/428

*Primary Examiner*—John G. Weiss
*Assistant Examiner*—Charles Anderson
*Attorney, Agent, or Firm*—Pro-Techtor International Services

[57] ABSTRACT

The present invention is to offer an improved structure of draining mechanism for soft nose protrusion type diving mask, which essentially comprises a valve flap seat with a plurality of through holes, is directly and integrally jointed at the bottom of a nose protrusion body of a soft liner frame when moulding the said frame of the diving mask and provided with an one-way valve flap; based on the integral structure of valve flap seat and nose protrusion body, when operating "balancing pressure" to tightly pinch the nose protrusion body, no gap will be formed between the valve flap seat and the nose protrusion body to effectively prevent infiltration water; and a bent flow-guiding device moulded integrally with and beneath the nose protrusion body and extended to the two sides of diving mask can drain and guide flow so as to prevent the exhausted bubbles from affecting the diver's visibility.

1 Claim, 2 Drawing Sheets

STRUCTURE OF DRAINING MECHANISM FOR SOFT NOSE PROTRUSION TYPE DIVING MASK

FIELD OF THE INVENTION

The present invention is related to an improved structure of draining mechanism for soft nose protrusion type diving mask and particularly to a draining mechanism which will never be distorted and deformed so as to avoid infiltration water while operating "balancing pressure".

DESCRIPTION OF THE PRIOR ART

The diving mask comprises essentially a mask frame and a soft liner frame, the former is designed to install lens and the latter is designed to wear for use and able to closely contact the diver's face. However, the people's faces vary with each other, so the diving mask cannot quite closely contact the diver's face, and the water outside will infiltrate into the mask from the position where leaves the close contact to be desired, and will trouble the diver's face. Too much infiltration water will seriously affect the diver's breathing and visibility, so the infiltration water has to be drained in time.

Nowadays the diving mask may be generally classified into two types: hard nose protrusion type and soft nose protrusion type. The former is made of a hard material through integral moulding together with the mask frame and the hard nose protrusion body. Since the hard nose protrusion body has a suitable hardness, a valve hole can be conveniently and directly provided in a suitable position and a valve seat is formed thereon for directly installing a valve flap to form a drain valve which is one-way open outward to let the infiltration water in the diving mask drain outward but prevent the water outside from infiltrating into the diving mask through the drain valve, and the diver can directly blow the infiltration water in the mask out from the drain valve through his direct expiration. However, in case of diving down to some different depths to operate "balancing pressure". To shut mouth and pinch nose, and then to expire to let the air pressure go to ears so as to oppose against the increase of water pressure outside, the diver cannot directly pinch his nose tightly from outside since the nose protrusion body is hard, so it is really troublesome and inconvenient for him to operate "balancing pressure".

The foregoing soft nose protrusion type diving mask are made of soft material through integral moulding together with the soft liner frame and the soft nose protrusion body which protrude outward from the mask frame, so when to operate "balancing pressure", the diver can directly pinch the soft nose protrusion body tightly from outside, namely, to tightly pinch his own nose by so doing, and he can only use his one thumb and one forefinger to pinch it tightly and operate "balancing pressure" very simply, quickly and conveniently. However, the nose protrusion body is soft and the base to support it is instable, a drain valve cannot be directly provided onto the nose protrusion body and the infiltration water in the mask cannot be drained through a natural and simple expiration, this is a drawback.

In view of the above, there is a kind of soft protrusion type diving mask with a drain mechanism wherein a through hole is provided at the bottom of nose protrusion body to joint an upper valve lid and a lower valve lid of which the adjacent surfaces jointly clamp the other positions of the said bottom around the said through hole, one of the upper and lower valve lids is provided with an one-way valve flap able to open outward, so the said soft protrusion type diving mask have the effect of drain and since the nose protrusion body thereof is soft, it is easy is easy to proceed with operating "balancing pressure".

However, during operating "balancing pressure" and pinching the nose protrusion body tightly, various positions of said nose protrusion body will be affected to deform, and at the same time, the bottom of nose protrusion body clamped and jointed by the upper and lower valve lids will also be affected to deform, and a gap will be formed between these two valve lids to let the water outside infiltrate into the mask quickly. So there is a drawback of infiltration water during operating "balancing pressure".

The present invention is designed to improve the foregoing drawbacks so that the draining mechanism and nose protrusion body will never lead to a phenomenon of infiltration water when operating "balancing pressure".

SUMMARY OF THE INVENTION

The present invention is characterized in a valve flag seat with a plurality of through holes. The said valve flag seat is directly and integrally jointed at the bottom of nose protrusion body of soft liner frame when moulding the said frame of diving mask and provided with an one-way valve flap; the integral structure of valve flag seat and nose protrusion body will never lead to a gap between the said seat and body but can effectively prevent infiltration water when operating "balancing pressure" through tightly pinching the said body.

The present invention is further characterized in a bent flow-guiding device beneath the nose protrusion body and extended to the two sides of diving mask for drain, flow guiding and preventing the exhausted bubbles from affecting the diving's visibility. The said body and flow-guiding device are integrally moulded together.

DETAILED DESCRIPTION OF PREFERRED EMBODIMENTS

Figure 1:
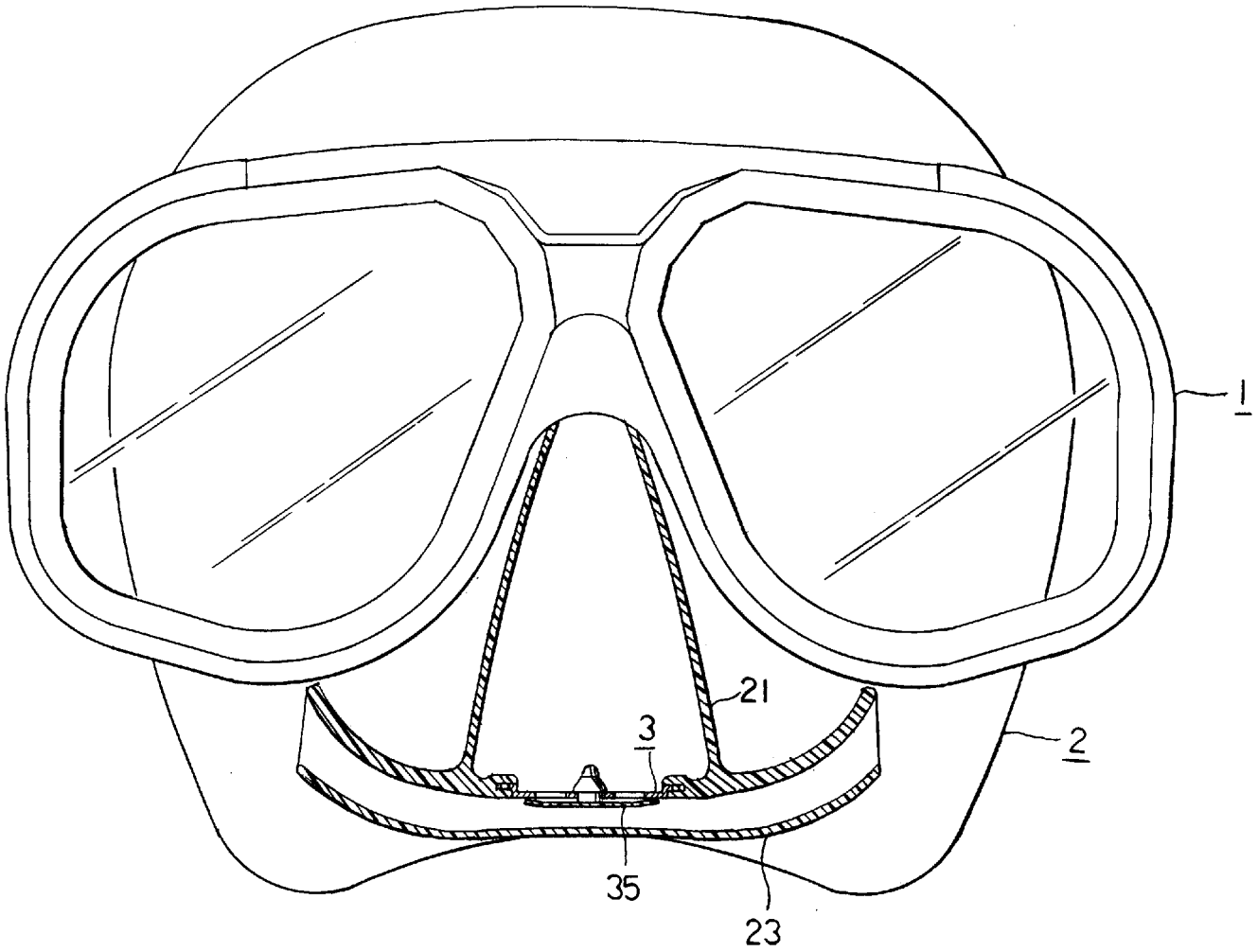
FIG. 1 is a front section view of the present invention.
Figure 3:
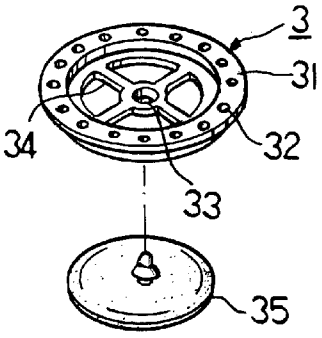
FIG. 3 is a breakdown view of valve flap seat and valve flap of the present invention.
Figure 4:
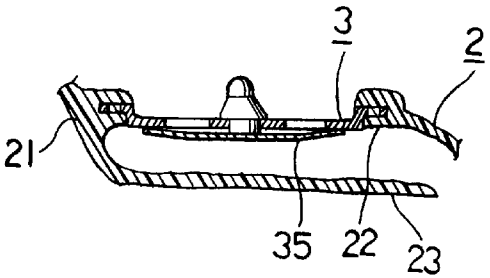
FIG. 4 is an enlarged view of Part A in FIG. 2.
Figure 2:
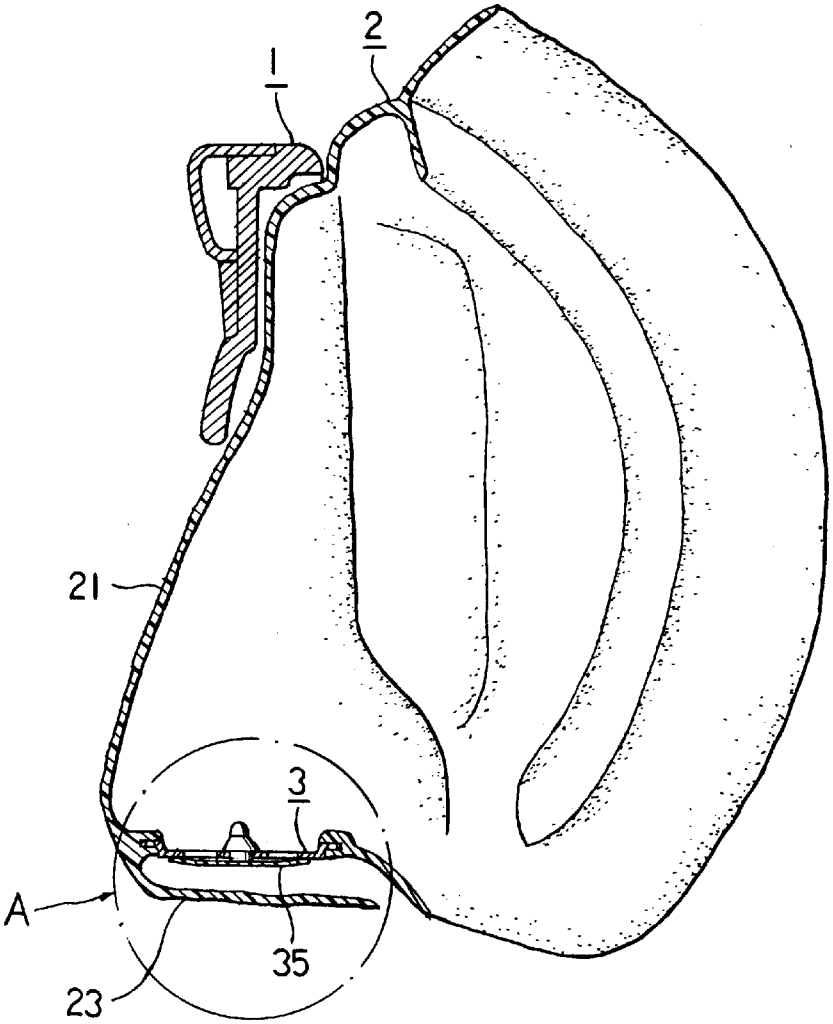
FIG. 2 is a side section view of the present invention.

As shown in the drawings, the present invention still comprises a mask frame 1 and a soft seat 2, but the most essential device of the present invention is a valve flap seat 3 comprising an outer annular body 31, a plurality of through holes 32, a central hole 33 at the center of valve flap seat 3, a plurality of ribs 34 connected the outer annular body 31, and an one-way valve flap 35 jointed with the central hole 33 and able to open one-way outward. The valve flap seat 3 is directly and integrally jointed onto the bottom 22 of nose protrusion body 21 of soft liner frame 2 through these through holes 32 so as to form an integral structure with the nose protrusion body 21.

Based on the relationship of integral structure between valve flap seat 3 and nose protrusion body 21, when operating "balancing pressure" to tightly pinch the nose protrusion body 21 until deformation, no gap will be formed there between, so the infiltration water phenomenon generated from the deformation of nose protrusion body 21 can be effectively prevented.

In addition, a bent flow-guiding device 23 mouled integrally with and beneath the nose protrusion body 21 and extended to the two sides of diving mask can guide flow and naturally guide bubbles moving to the two sides of the mask so as to avoid the exhausted bubbles from hindering the diver's visibility when he expires to exhaust the infiltration water in the mask through the valve flap 35 and leads to generating bubbles.

We claim:

1. A draining mechanism in combination with a soft nose protrusion type diving mask, comprising:

a mask frame and a soft liner frame, said soft liner frame is provided with a nose protrusion body with a valve flap seat at a bottom end of said nose protrusion body, said valve flap seat comprises an outer annular body, a plurality of through holes, a central hole at a center of said valve flap seat, a plurality of ribs connected to said outer annular body, and a flexible one-way valve flap covers an outer surface of said valve flap seat and is secured in said central hole of said valve flap seat, said valve flap opens only outward, said valve flap seat is directly and integrally attached to said bottom end of said nose protrusion body of said soft liner frame through said through holes during a molding process that forms said nose protrusion body, such that when "balancing pressure", a user pinches said nose protrusion body until said nose protrusion body is deformed, no gap is formed between said nose protrusion body and said valve flap seat, so that the infiltration water phenomenon generated by the deformation of said nose protrusion body is prevented, said diving mask further includes an airflow-guiding means molded integrally with and beneath said nose protrusion body, said airflow-guiding means extends to two sides of said diving mask so that said airflow-guiding means guides air flow created by the diver's exhaling and causes bubbles formed thereby to flow to said two sides of said diving mask so that a diver's visibility is not hindered when the diver generates bubbles by exhaling.

* * * * *